US005338020A

United States Patent [19]

Eltner et al.

[11] Patent Number: 5,338,020

[45] Date of Patent: Aug. 16, 1994

[54] DEVICE FOR ALIGNING A SHEET PILE

[75] Inventors: Bruno Eltner, Heidelberg; Erich M. Zahn, Eppelheim, both of Fed. Rep. of Germany

[73] Assignee: Heidelberger Druckmaschinen AG, Heidelberg, Fed. Rep. of Germany

[21] Appl. No.: 940,198

[22] Filed: Sep. 2, 1992

[30] Foreign Application Priority Data

Sep. 2, 1991 [DE] Fed. Rep. of Germany ..... 4129136

[51] Int. Cl.[5] ..... B65H 1/30

[52] U.S. Cl. ..... 271/158; 414/790.8

[58] Field of Search ..... 271/218, 220, 157, 158, 271/159; 414/907, 789.1, 790.8

[56] References Cited

U.S. PATENT DOCUMENTS

| | | | |
|---|---|---|---|
| 3,975,011 | 8/1976 | Marass | 271/157 |
| 4,174,831 | 11/1979 | Marass et al. . | |
| 4,764,074 | 8/1988 | Postigo | 414/789.1 |
| 4,765,790 | 8/1988 | Besemann | 414/790.8 |
| 4,949,953 | 8/1990 | Claasen et al. | 414/790.8 |

FOREIGN PATENT DOCUMENTS

| | | | |
|---|---|---|---|
| 0359920 | 3/1990 | European Pat. Off. | 414/790.8 |
| 2505762 | 6/1976 | Fed. Rep. of Germany | 271/159 |
| 2637086 | 12/1977 | Fed. Rep. of Germany . | |
| 2939267 | 4/1981 | Fed. Rep. of Germany . | |
| 3411886 | 10/1984 | Fed. Rep. of Germany . | |
| 1-321221 | 12/1989 | Japan . | |
| 2137177 | 10/1984 | United Kingdom . | |

*Primary Examiner*—H. Grant Skaggs

*Attorney, Agent, or Firm*—Herbert L. Lerner; Laurence A. Greenberg

[57] ABSTRACT

A device for aligning a sheet pile in a sheet feeder of a sheet processing machine feedable with sheets therefrom having a front stop provided for a first lateral face of the sheet pile facing towards the machine includes a horizontal stop rail coordinated with a second lateral face of the sheet pile located on a side of the sheet pile opposite to the first lateral face thereof, the stop rail being formed with a directive surface disposed directly opposite the second lateral face of the sheet pile, an automatic adjusting device for pressing the directive surface against the second lateral face of the sheet pile under action of a directive force, and a positioning device for setting the stop rail at selective levels.

1 Claim, 11 Drawing Sheets

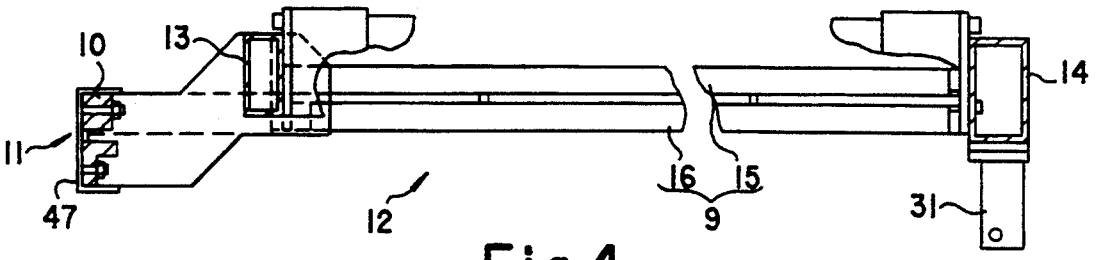
Fig.4
Fig.3
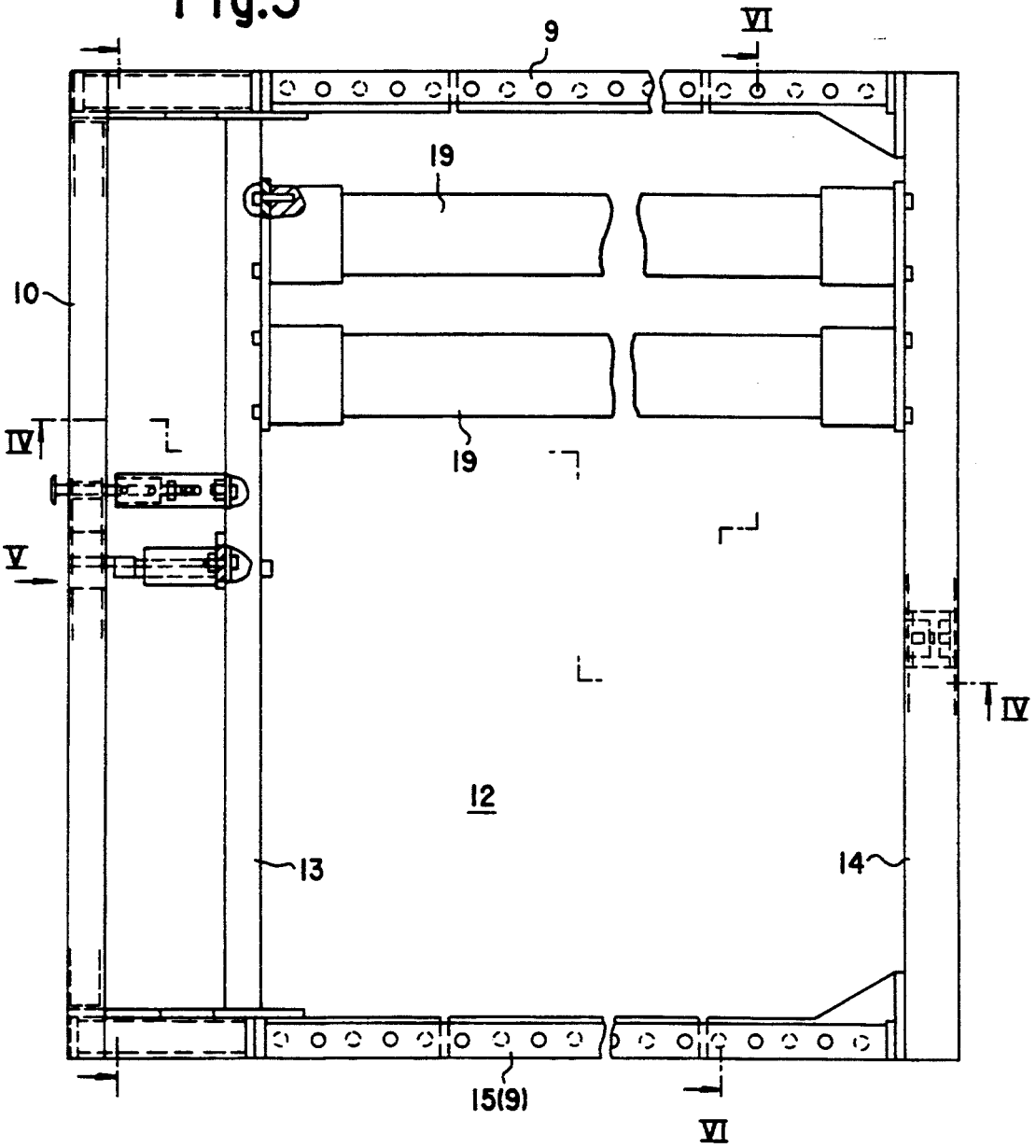

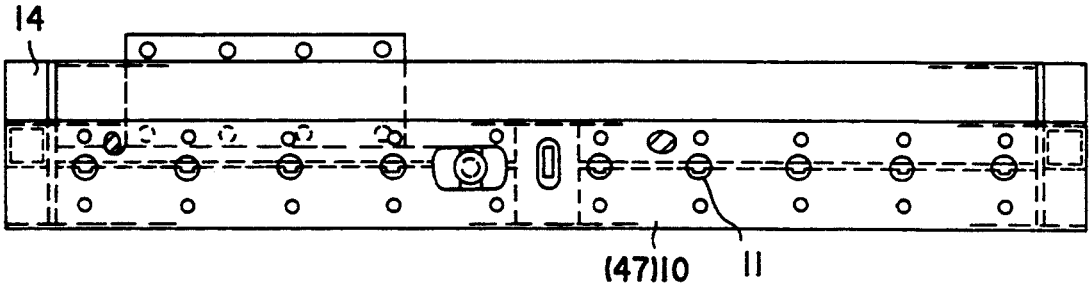
Fig.5
Fig.6
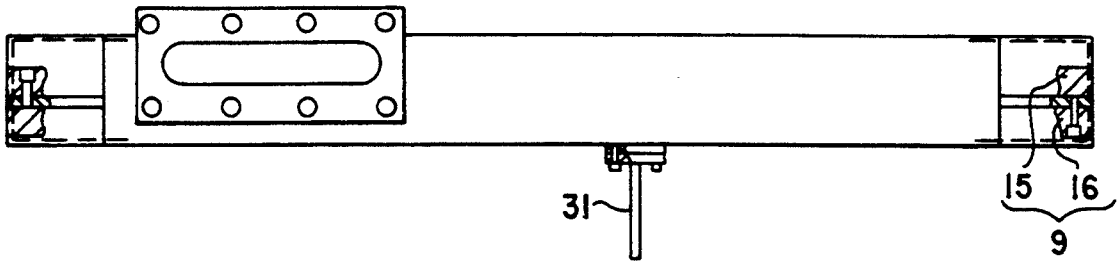

DEVICE FOR ALIGNING A SHEET PILE

The invention relates to a device for aligning a sheet pile in a sheet feeder of a sheet-processing machine feedable with sheets therefrom, including a front stop provided for a first lateral face of the sheet pile facing towards the machine.

It has become known heretofore, to probe with a detector an upper edge of a sheet pile located in a sheet feeder of a sheet processing machine, especially a printing machine, wherein the upper edge faces towards the machine, and to control a drive with corresponding signals from the detector so that the upper edge of the sheet pile maintains a given level (note German Published Document 34 11 886 A1). Depending upon the construction of such a detector, it may be necessary that a given horizontal spacing between the detector and a probed section of the upper edge not be exceeded. This may be the case if the sheet pile does not precisely engage conventional front stops in such sheet feeders, e.g. the sheet pile is disposed obliquely or at an inclination to the processing direction or has a crooked or bent front-side face in this direction. Such irregularities may, however, result in a sheet which has been removed from the sheet pile by a sheet singling or separating device and sent on its way in a direction towards the sheet-processing machine, not being gripped completely accurately by conventional so-called timed rollers in such sheet feeders. The foregoing irregularities may also cause disruptions in the operation of a sheet-processing machine.

It is accordingly an object of the invention to provide a device for aligning a sheet pile of the foregoing general type which avoids disruptions in the operation of a sheet processing machine associated therewith, insofar as the cause of these disruptions is that a sheet pile in the sheet feeder does not precisely engage conventional front stops in such a sheet feeder.

With the foregoing and other objects in view, there is provided, in accordance with the invention, a device for aligning a sheet pile in a sheet feeder of a sheet processing machine feedable with sheets therefrom, including a front stop provided for a first lateral face of the sheet pile facing towards the machine, comprising a horizontal stop rail coordinated with a second lateral face of the sheet pile located on a side of the sheet pile opposite to the first lateral face thereof, the stop rail being formed with a directive surface disposed directly opposite the second lateral face of the sheet pile, automatic adjusting means for pressing the directive surface against the second lateral face of the sheet pile under action of a directive force, and a positioning device for setting the stop rail at selective levels.

In accordance with another feature of the invention, the front stop is formed of vertically disposed stop bars.

In accordance with a concomitant feature of the invention, the stop rail with the directive surface is mounted in a device for uniting a residual sheet pile located in an upper region of a pile zone in the sheet feeder, and a main sheet pile located in a lower region of the pile zone into an aggregate sheet pile, the pile uniting device being located upstream of the sheet feeder in a slide-in direction of the sheet piles, and including a rake having mutually parallel lattice bars for temporarily carrying the residual sheet pile, the stop rail with the directive surface, in a phase of the pile uniting process, being in engagement, in vicinity of the lattice bars, with the respective second lateral face of the residual sheet pile and the main sheet pile, the second lateral face facing away from the front stop.

The device according to the invention is, moreover, manifestly advantageous when only relatively low-level demands are made thereon when it is introduced at the prepiling of sheet piles, and trouble-free operation in the aforementioned sense, also without any manual aligning work by a pressman or other servicing personnel, is assumed.

Other features which are considered as characteristic for the invention are set forth in the appended claims.

Although the invention is illustrated and described herein as embodied in device for uniting a residual pile of sheets and a main pile of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a much-enlarged fragmentary view of FIG. 2 showing a frame removed from a displacement device of FIG. 2.

FIG. 4 is a sectional view of FIG. 3 taken along the line IV—IV in the direction of the arrows;

FIG. 5 is another sectional view of FIG. 3 taken along the line V—V in the direction of the arrows;

FIG. 6 is a further sectional view of FIG. 3 taken along the line VI—VI in the direction of the arrows;

Figure 1:
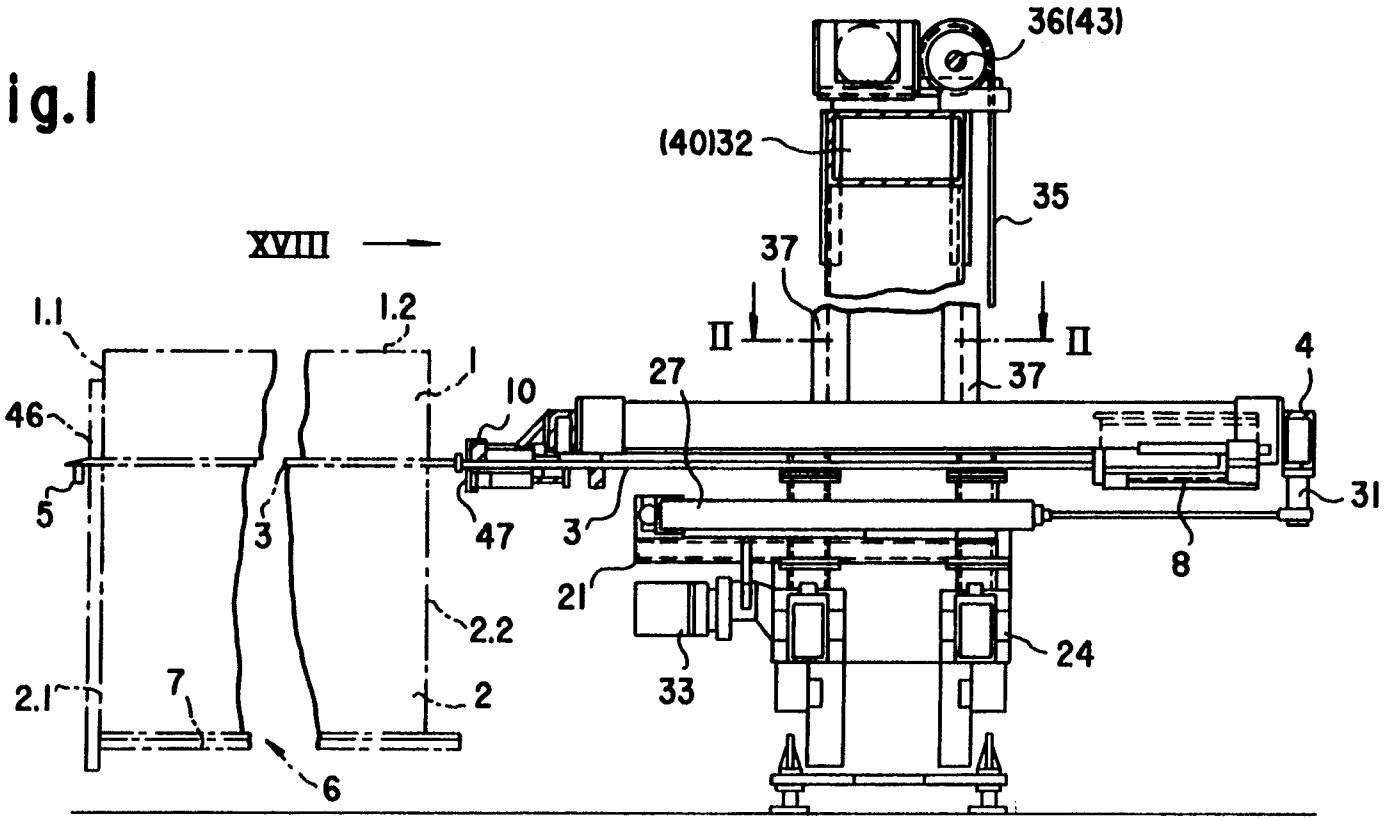
FIG. 1 is a front elevational view of a device for unifying a residual sheet pile and a main sheet pile including a device according to the invention and its association with a sheet pile arrangement in a sheet feeder.

Referring now to the figures of the drawings and, first, particularly to FIG. 1 thereof, there is shown therein an embodiment of the device for aligning a sheet pile, in accordance with the invention, wherein a stop rail 10 is integrated into a device disposed upstream of a sheet feeder in a slide-in direction of the sheet pile, for uniting a residue sheet pile 1 located in an upper region of a pile zone in a sheet feeder and a main sheet pile located in a lower region of the pile zone into an aggregate sheet pile, a rake 8 with mutually parallel lattice bars 3 being utilized for temporarily carrying the residual sheet pile 1, the stop rail 10, in a phase of the pile uniting process, being engaged with a respective lateral face of the residual sheet pile 1 and of the main sheet pile 2, which faces away from a front stop 46. The pile zone of the sheet feeder is shown in FIG. 1 only diagrammatically by representing the residual pile of sheets 1 and the main pile of sheets 2 in phantom in a phase of the pile uniting process wherein the residual pile of sheets 1 is seated with its lowermost sheet on horizontally disposed lattice bars 3 of a displacement device, identified as a whole by reference numeral 4, and wherein the main pile of sheets 2 is in contact from below, with the uppermost sheet thereof against the lattice bars 3, the lattice bars 3 being in the position shown in phantom, which is offset in the longitudinal direction of the lattice bars 3 with respect to the position thereof shown in solid lines. The free ends of the lattice bars 3 projecting beyond a side surface of the pile arrangement are supported in a conventional manner by means of an auxiliary traverse or cross-member 5, shown in cross section in FIG. 1.

The main pile 2 is seated with its lowermost sheet on a pile-carrying plate 6. In a sheet feeder of a printing press, a pile of sheets seated on such a pile-carrying plate is raised, during a production run, by means of conventional lifting mechanisms to the same extent as the height of the pile of sheets decreases, until the pile finally becomes a residual pile of sheets. If the displacement device 4, therefore, is installed in conjunction with a sheet feeder of a printing press then, prior to being united with the main pile 2, the residual pile of sheets is initially seated, likewise, with its lowermost sheet on a pile-carrying plate 6 until the pile-carrying plate 6 is removed in a conventional manner by being lowered by the aforementioned lifting mechanisms after the residual pile of sheets 1 has been underpinned by means of the lattice bars 3. Mutually parallel grooves 7 are formed, in a conventional manner, on the horizontally aligned upper side of the pile-carrying plate 6. A group of the mutually parallel lattice bars 3 is assembled to form a rake 8, the cross sections of the lattice bars 3 and of the grooves 7 being so coordinated that the lattice bars 3 can be inserted, in the longitudinal direction thereof, into the grooves 7 so that, in a phase of the uniting process, the residual pile of sheets 1 is underpinned by the lattice bars 3.

In order to displace the lattice bars 3 in the longitudinal direction thereof, guide rails 9 on which the rake 8 is displaceably held are provided for this purpose in the displacement device 4.

The phase of the uniting process shown in FIG. 1, with a view of the mutual positions of the residual pile 1, the main pile 2 and the lattice bars 3 enclosed therebetween, is followed, in a final phase of the uniting process, by the removal of the lattice bars 3 from the illustrated pile arrangement, in a removal direction towards the right-hand side of FIG. 1. In order to prevent sheets which are in the vicinity of the lattice bars 3 from being displaced likewise in the removal direction, the aforementioned stop rail 10, which is disposed horizontally and extends transversely to the longitudinal direction of the lattice bars 3, is provided and is displaceable in the longitudinal direction of the lattice bars 3, the stop rail 10 being formed with penetrations 11 discernible in FIGS. 4 and 5 for affording passage of the lattice bars 3 through the stop rail 10. A directive surface 47 provided on the stop rail 10 is disposed directly opposite lateral faces 1.2 and 2.2, respectively of the residue sheet pile 1 and the main sheet pile 2, these lateral faces 1.2 and 2.2 being located on the opposite side of the respective sheet piles from the lateral faces 1.1 and 2.1, respectively, thereof.

Figure 2:
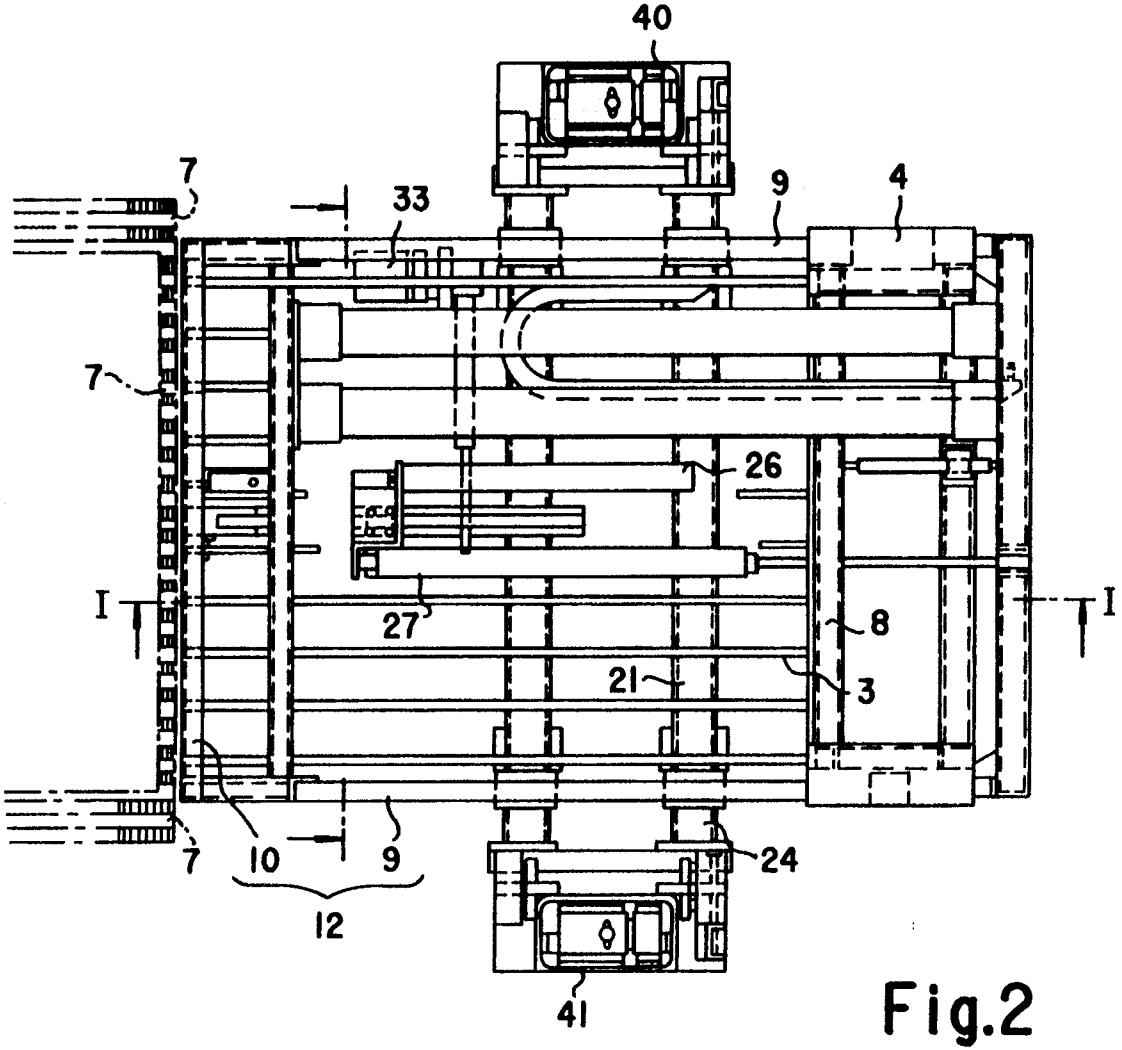
FIG. 2 is an enlarged cross-sectional view of FIG. 1 taken along the line II—II in the direction of the arrows.

As is apparent from FIG. 2, the guide rails 9, respectively, form a side part of a frame 12, and the stop rail 10 forms an end or front leg of the frame 12.

The frame 12, which is shown in FIG. 3 removed from the displacement device 4 and in a position corresponding to the position thereof shown in FIG. 2, is additionally stiffened by means of a first cross-strut 13 at a front end (situated at the left-hand side of FIG. 3) and by means of a second cross-strut 14 at a rear end of the guide rail 9 (situated at the right-hand side of FIG. 3).

Figure 7:
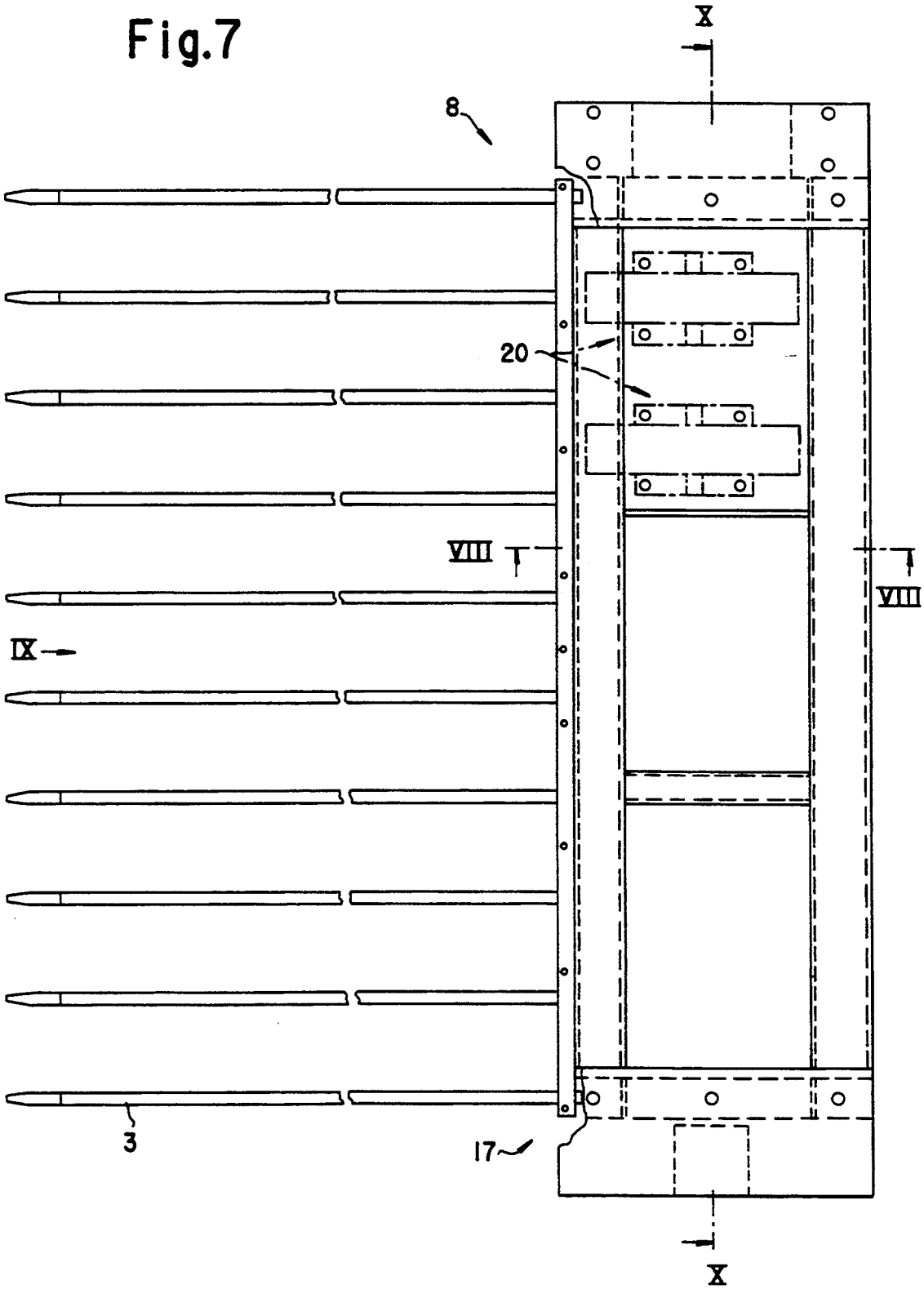
FIG. 7 is a top plan view of a rake, removed from the displacement device of FIG. 2.
Figure 8:
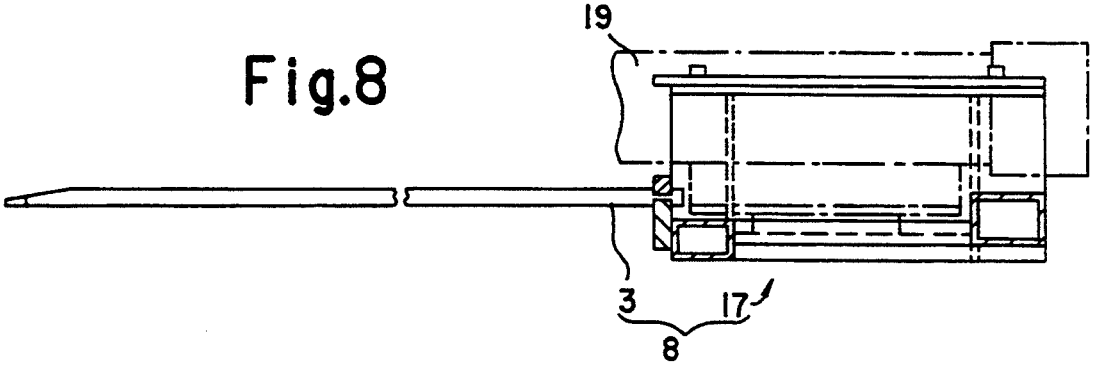
FIG. 8 is a cross-sectional view of FIG. 7 taken along the line VIII—VIII in the direction of the arrows.
Figure 9:
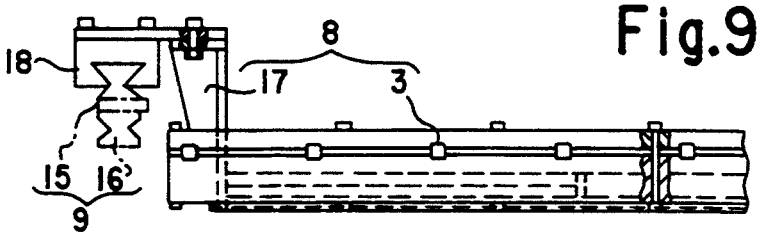
FIG. 9 is another fragmentary cross-sectional view of FIG. 7 taken along line IX—IX in the direction of the arrows.

As can be seen from FIG. 6, each guide rail 9 is assembled of an upper guide bar 15 and of a lower guide bar 16, the upper guide bar 15 serving as a straight guide for the rake 8, which is shown in FIG. 7 removed from the displacement device 4 and in a position corresponding to the position thereof in FIG. 2. The rake 8 is formed by a bridge 17 in which the lattice bars 3 are clamped by one of the ends thereof, respectively, as can be seen most clearly in FIG. 8. The bridge 17 extends transversely to the longitudinal direction of the lattice bars 3 and has bridge bearings in the form of straight guide sections or profiles 18, each of which embraces an upper guide bar 15 of one of the guide rails 9. FIG. 9 shows how the straight guide sections 18 are connected to an upper guide bar 15, with the upper and lower guide bars 15 and 16 each being represented in phantom. The guide rails 9 and the lattice bars 3 extend parallel to one another, so that the rake 8 is supported in a manner that it is displaceable with respect to the frame 12 in the longitudinal direction of the lattice bars 3.

Figure 10:
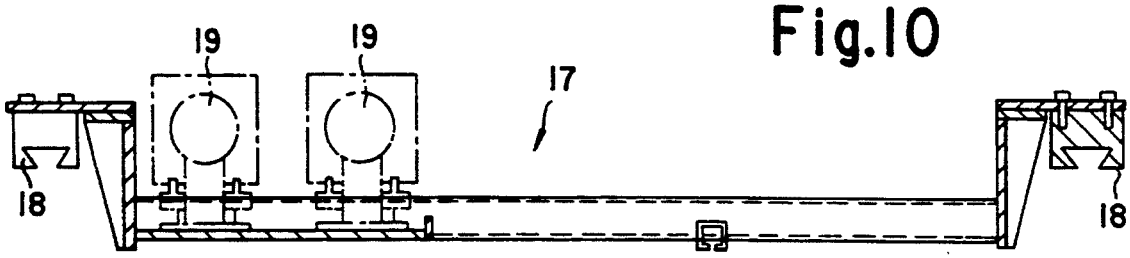
FIG. 10 is a further sectional view of FIG. 7 taken along the line X—X in the direction of the arrows.

The illustrated embodiment provides for an independent displacement of the rake 8 with respect to the frame 12. With regard thereto, band cylinders 19 are disposed between the first and the second cross-struts 13 and 14 of the frame 12 and oriented parallel to the guide rails 9, the band cylinders 19, as indicated in phantom in FIG. 10, having bands which are connected to the bridge 17 of the rake 8. In FIG. 7, corresponding connecting means 20 for connecting the bands of the band cylinders 19 to the bridge 17 are shown diagrammatically and in phantom.

The frame 12, in turn, is mounted so that it is displaceable in the longitudinal direction of the lattice bars 3 and in the horizontal transverse to the longitudinal direction of the lattice bars 3. In the embodiment of FIGS. 1 and 2, the displacement device is equipped with a cross-slide 21 for this purpose.

Figure 11:
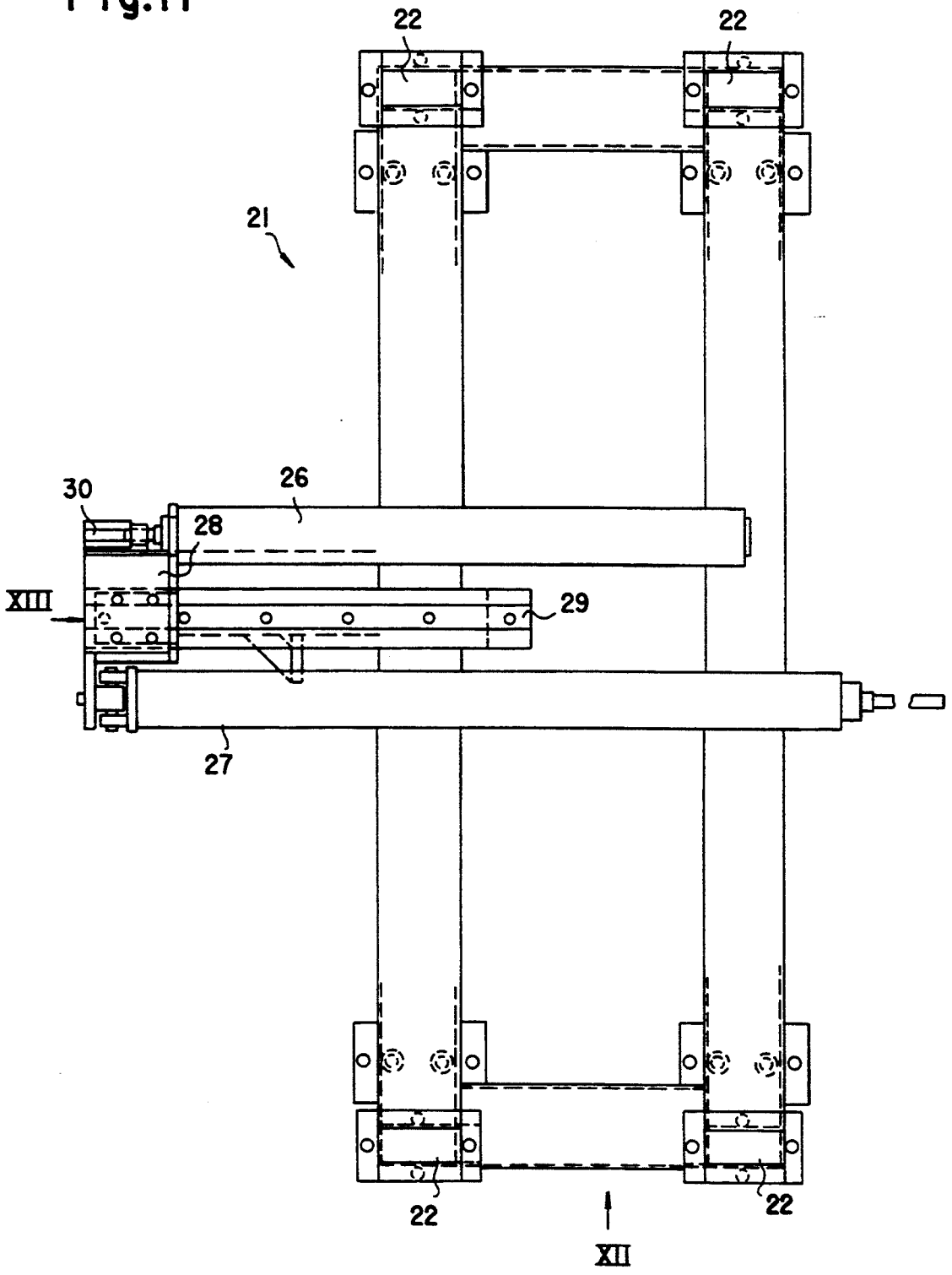
FIG. 11 is a top plan view of a cross-slide removed from the displacement device of FIG. 2.
Figure 12:
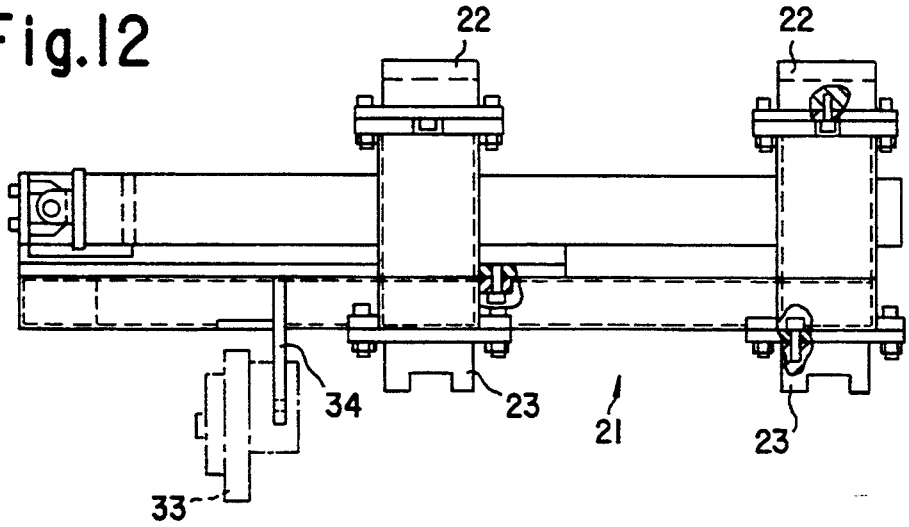
FIG. 12 is a side elevational view of the cross-slide as seen in the direction of arrow XII in FIG. 11.
Figure 13:
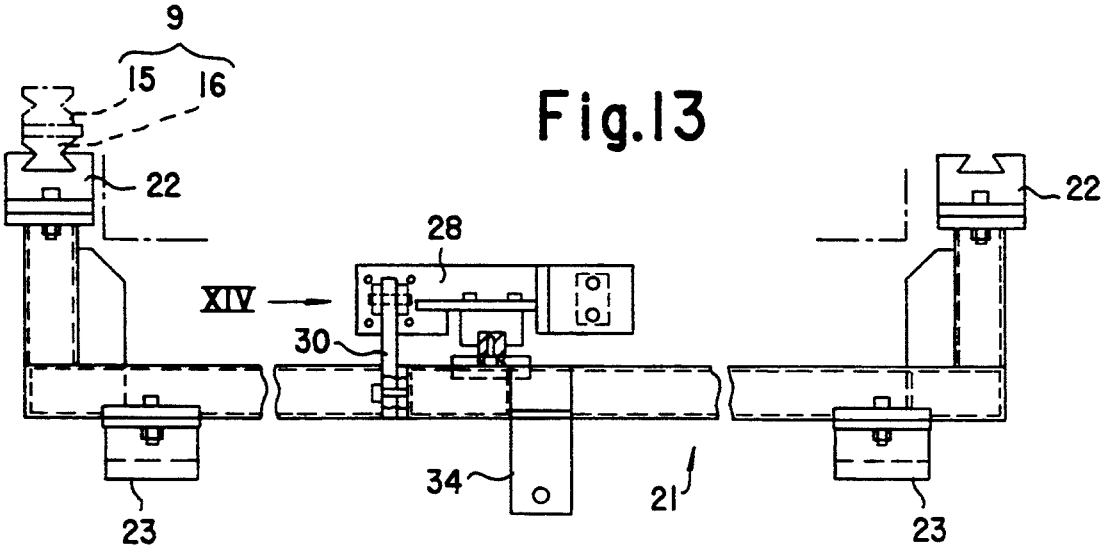
FIG. 13 is another side elevational view of the cross-slide as seen in the direction of arrow XIII in FIG. 11.

The cross-slide 21, which is illustrated in FIG. 11 removed from the displacement device 4 and in a position corresponding to the position thereof shown in FIG. 2, extends transversely to the lattice bars 3 from a guide rail 9 on a first longitudinal side of the frame 12 to the opposite guide rail 9 on a second longitudinal side of the frame 12, and has straight guide sections 22 corresponding to the straight guide sections 18 (FIGS. 9 and 10) provided on the rake 8. These straight guide sections 22 embrace a respective lower guide bar 16 of a respective guide rail 9. Thus, the frame 12, with respect to the cross-slide 21, and the rake 8, with respect to the frame 12, are displaceable in the longitudinal direction of the lattice bars 3, the cross-slide 21 itself being equipped with other straight guide sections 23 oriented transversely with respect to the lattice bars 3 (note FIGS. 12 and 13). The straight guide sections 23 will be discussed hereinafter in greater detail.

Figure 14:
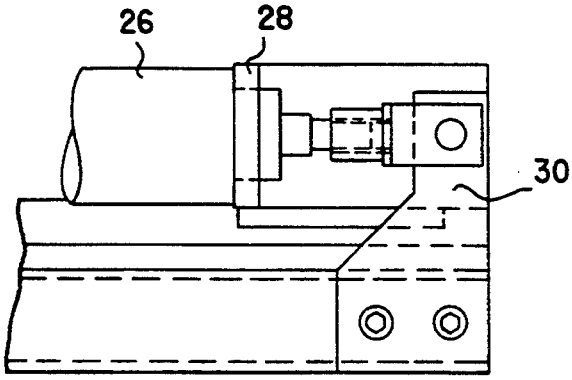
FIG. 14 is an enlarged fragmentary elevational view in the direction of arrow XIV in FIG. 13.

To press the directive surface 47 formed on the frame 12 in the illustrated embodiment against the lateral faces 1.2 and 2.2, respectively, automatic adjusting means in the form of a piston-cylinder arrangement are provided, which includes a first cylinder 26 and a second cylinder 27, acting between the cross-slide 21, on the one hand, and the frame 12, on the other hand. The first cylinder 26 is flanged onto a guide head 28, which is guided by means of a slideway 29 oriented in the longitudinal direction of the lattice bars 3 and attached to the cross-slide 21, while the piston rod of the first cylinder 26 is swivel-mounted on a strap 30 attached to the cross-slide 21 (see FIG. 11, 13 and 14). The second cylinder 27 is articulatingly mounted at its one end on the guide head 28, while the end of the piston rod of the second cylinder 27 facing away from the one end is connected in an articulating manner to a further strap 31 (note FIG. 1, for example), which, in turn, is attached to the frame 12.

For adjusting to desired heights or levels of the stop rail 10, a positioning device in the form of a lifting device carrying the displacement device 4 is provided which serves simultaneously, for lowering and raising the rake 5. The lifting device has a horizontal cross-member arrangement 24, which is oriented transversely to the lattice bars 3.

Figure 15:
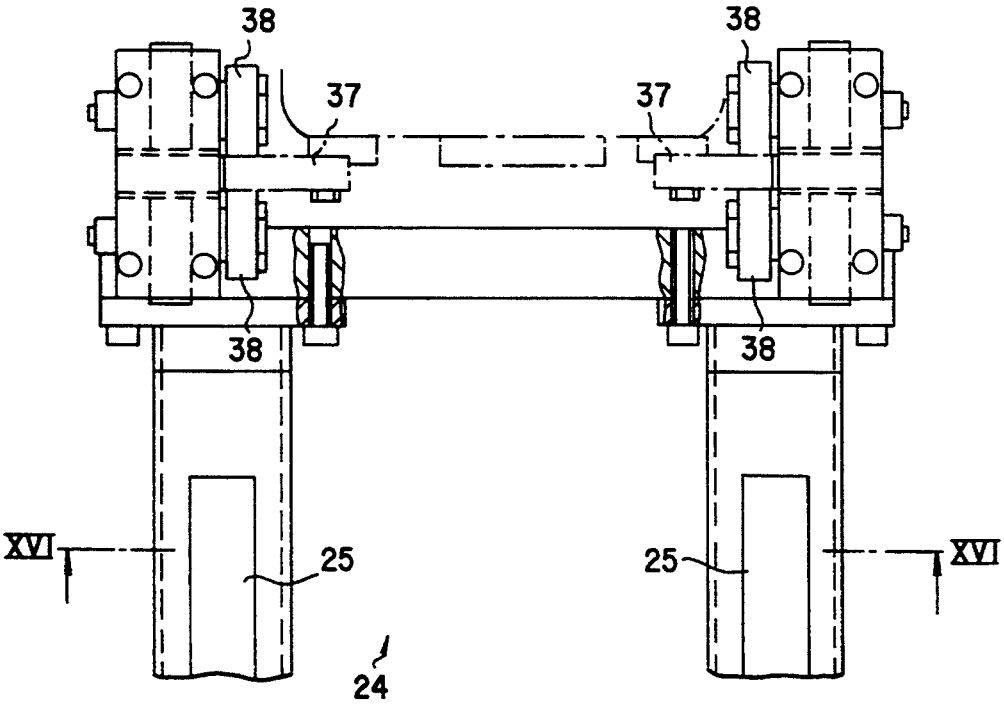
FIG. 15 is a much-enlarged fragmentary view of FIG. 2 showing a cross-member arrangement thereof removed from the displacement device.

The cross-member arrangement 24, shown in FIG. 15 removed from the lifting device and in a position corresponding to the position thereof shown in FIG. 2, is provided in the illustrated embodiment with horizontally extending straight guide tracks 25 oriented transversely to the lattice bars 3 and being in engagement with the aforementioned straight guide sections 23 provided on the cross-slide 21.

The illustrated embodiment of the device according to the invention further provides for the independent displacement of the cross-slide 21 with respect to the cross-member arrangement 24. For this purpose, a linear servo-drive 33 is mounted on the cross-member arrangement 24, and a pushrod of the linear servo-drive 33 is articulatingly connected to another strap 34 which is fastened to the cross-slide 21.

Figure 16:
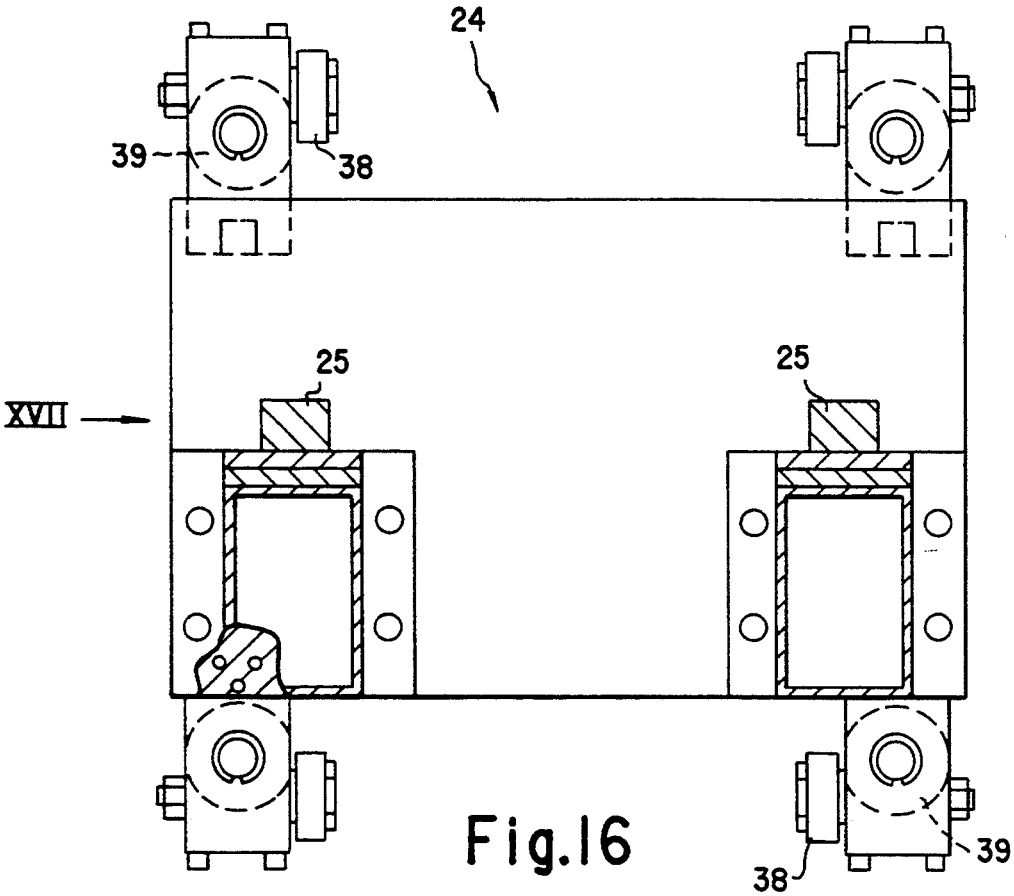
FIG. 16 is a sectional view of FIG. 15 taken along the line XVI—XVI in the direction of the arrows.
Figure 17:
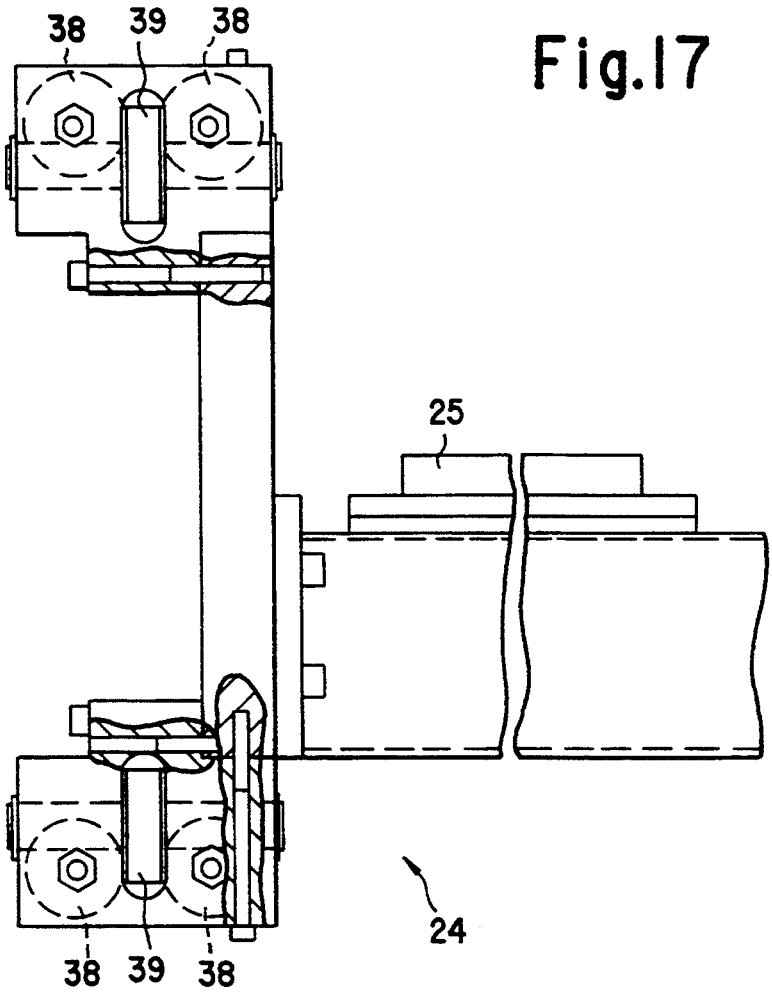
FIG. 17 is a side elevational view of the cross-member arrangement as seen in the direction of arrow XVII in FIG. 16.
Figure 18:
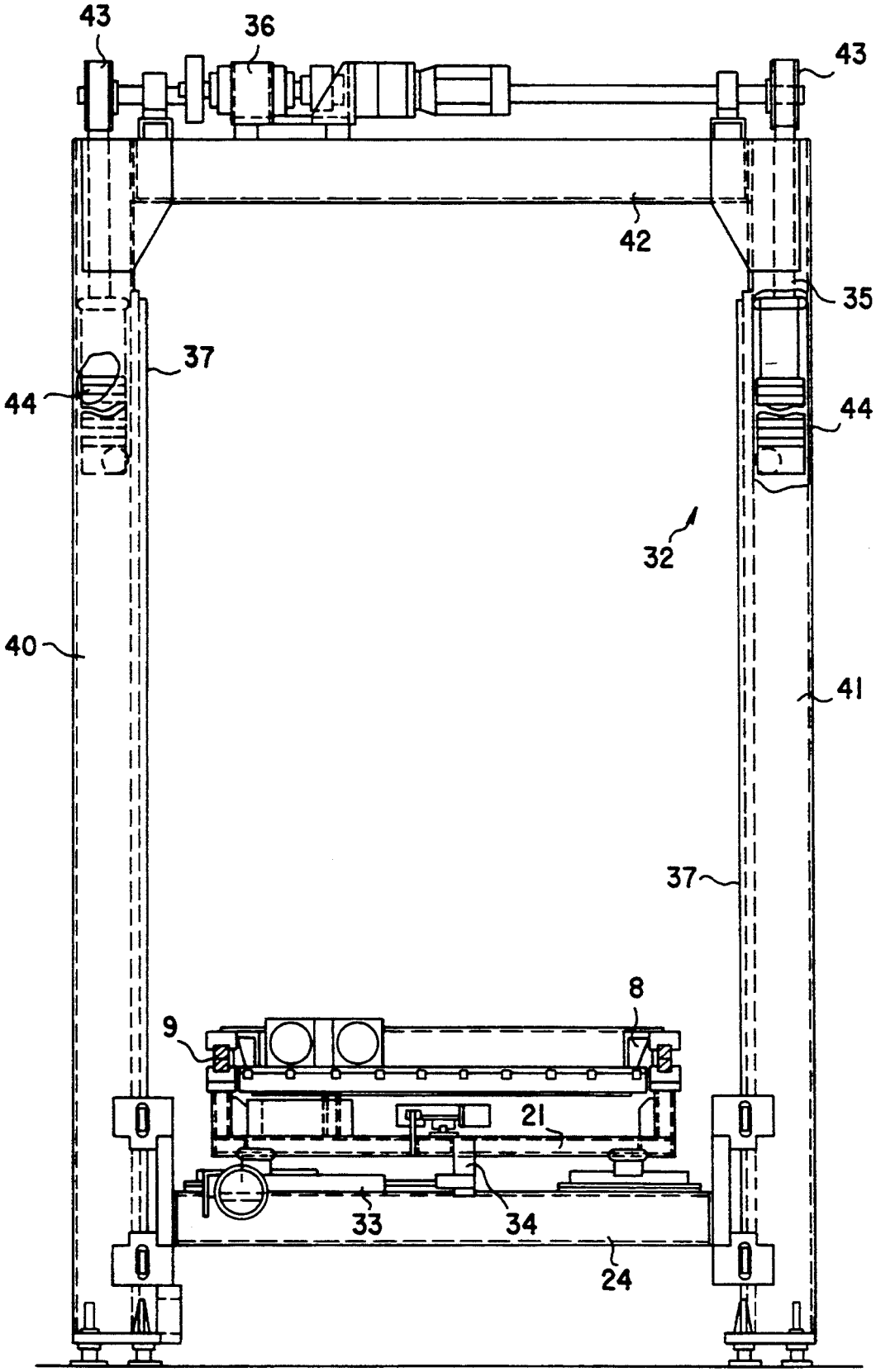
FIG. 18 is an elevational view of the device according to the invention as seen in the direction of arrow XVIII in FIG. 1.

In FIGS. 15, 16 and 17, there is shown one end of the cross-member arrangement 24, which can be seen in its entirety in FIG. 18. The cross-member arrangement 24 is connected, in a manner not shown in greater detail, through the intermediary of traction means 35 attached thereto, such as a chain or a toothed belt, to a lifting drive 36 (note FIGS. 1 and 18) and is vertically movable along a lifting cradle 32. For this purpose, each end of the cross-member arrangement 24 is guided on vertically extending guideways 37 provided on a lifting cradle 32.

In the illustrated embodiment, the guideways 37 are in the form of rectangular section bars, the cross sections of which are represented in phantom in FIG. 15.

Respective ends of the cross-member arrangement 24 are each provided with rollers 38 and 39, which roll on the guideways 37 and which are so disposed that they fix the cross-member arrangement 24 transversely with respect to the longitudinal direction of the guideways 37.

The lifting cradle 32 is of self-supporting construction and, as can be seen most clearly in FIG. 1, is erected outside the pile zone, which is represented schematically in FIG. 1 by the residual pile 1 and the main pile 2 shown in phantom. The lifting cradle 32 is composed of a first column 40, a second column 41 and a yoke 42 (FIG. 18), the yoke 42 connecting the upper ends of the columns 40 and 41. The lifting cradle 32 thus forms a two-legged gantry. The respective columns 40 and 41 are formed of a hollow section or profile.

In the illustrated embodiment of the device according to the invention, the traction means 35 provided for raising and lowering the cross-member arrangement 24 are represented by toothed belts. Guide wheels 43 having suitable toothing to match the toothed belts are held on the yoke 42 and are each surrounded by a toothed belt, a first side of each toothed belt bearing the cross-member arrangement 24 and a second side of each toothed belt bearing a counterweight 44, which dips into the hollow section of the respective column 40, 41.

We claim:

1. A sheet feeder for feeding a sheet processing machine comprising: a non-stop feeding device for continuously feeding sheets in a sheet-feeding direction to the sheet processing machine wherein said non-stop feeding device is operative for combining a residual sheet pile with a main sheet pile into an aggregate sheet pile, the sheet feeder including a front step engaging a first lateral face of the residual sheet pile and of the main sheet pile, said first lateral face facing the sheet processing machine; the non-stop feeding device including a vertically adjustable displacement device which is horizontally displaceable into and against said sheet feeding direction, said displacement device including a frame horizontally displaceable into and against said sheet feeding direction and a plurality of lattice bars disposed in direction parallel with the sheet feeding direction, and being horizontally movable with respect to said frame into and against said sheet feeding direction, said lattice bars bearing the residual sheet pile in a first combining phase; the non-stop feeding device further including a vertically adjustable horizontally disposed stop rail adapted to engage a second lateral face of the residual sheet pile and the main sheet pile in a region adjacent to said lattice bars in a second combining phase of combining the residual sheet pile with the main sheet pile, and wherein said second lateral face faces away from said front stop; said non-stop feeding device further comprising an aligning bar disposed at least within the range of the height of the aggregate sheet pile; said non-stop feeding device further including height selecting means coupled to said aligning bar for selectively adjusting the height thereof, said aligning bar being adapted to align selected parts of said aggregate sheet pile at said front stop, said stop rail being part of said frame and serving as said aligning bar.

* * * * *